US008717855B2

(12) United States Patent
Sato et al.

(10) Patent No.: US 8,717,855 B2
(45) Date of Patent: May 6, 2014

(54) DIAL PLATE STRUCTURE AND WATCH

(75) Inventors: Junichi Sato, Hino (JP); Shunya Shiraishi, Akishima (JP)

(73) Assignee: Casio Computer Co., Ltd., Tokyo (JP)

( * ) Notice: Subject to any disclaimer, the term of this patent is extended or adjusted under 35 U.S.C. 154(b) by 80 days.

(21) Appl. No.: 13/597,927

(22) Filed: Aug. 29, 2012

(65) Prior Publication Data

US 2013/0051198 A1 Feb. 28, 2013

(30) Foreign Application Priority Data

Aug. 30, 2011 (JP) ..... 2011-187266

(51) Int. Cl.
*G04B 19/06* (2006.01)

(52) U.S. Cl.
USPC ..... 368/223; 368/228

(58) Field of Classification Search
USPC ..... 368/223, 228, 232, 233, 80
See application file for complete search history.

(56) References Cited

U.S. PATENT DOCUMENTS

| | | | | |
|---|---|---|---|---|
| 372,074 | A * | 10/1887 | Kuhn | 368/229 |
| 2,305,283 | A | 12/1942 | Theilkas | |
| 3,702,530 | A | 11/1972 | Besson et al. | |
| 4,548,512 | A | 10/1985 | Erard | |
| 5,044,961 | A | 9/1991 | Bruskewitz | |
| 5,181,190 | A * | 1/1993 | Kanzaki | 368/76 |
| 5,222,053 | A * | 6/1993 | Ohhira | 368/73 |
| 5,889,736 | A | 3/1999 | Fujita et al. | |
| 6,430,112 | B1 * | 8/2002 | Amano | 368/223 |
| 6,490,230 | B1 | 12/2002 | Sakuyama et al. | |
| 8,144,547 | B2 | 3/2012 | Plancon et al. | |
| 2006/0268666 | A1 * | 11/2006 | Lizzi | 368/223 |
| 2007/0041277 | A1 | 2/2007 | Gerber et al. | |
| 2009/0059732 | A1 | 3/2009 | Bracher et al. | |
| 2009/0257318 | A1 | 10/2009 | Hiraya | |
| 2013/0051193 | A1 | 2/2013 | Sato | |

FOREIGN PATENT DOCUMENTS

JP 2009-281961 A 12/2009

OTHER PUBLICATIONS

U.S. Appl. No. 13/597,844; First Named Inventor: Junichi Sato; Title: "Wristwatch Provided With Function Display Portion"; filed Aug. 29, 2012.

* cited by examiner

*Primary Examiner* — Amy Cohen Johnson
*Assistant Examiner* — Matthew Powell
(74) *Attorney, Agent, or Firm* — Holtz, Holtz, Goodman & Chick, PC

(57) ABSTRACT

A dial plate structure includes first and second dial plates and a rotary indicator. The first dial plate has a first opening or a first cutout. The second dial plate is arranged under the first dial plate and has a plurality of function display portions exposed through the opening or the cutout. The rotary indicator is arranged between the first and second dial plates and has a function indicator to selectively indicate one of the function display portions by rotation. The rotary indicator is partially exposed through the opening or the cutout. The rotary indicator has, on the surface thereof, a plurality of index markers respectively corresponding to the function display portions. The first dial plate has a second opening or a second cutout to expose one of the index markers when the function indicator indicates one of the function display portions corresponding to the indicated function display portion.

15 Claims, 8 Drawing Sheets

DIAL PLATE STRUCTURE AND WATCH

BACKGROUND OF THE INVENTION

1. Field of the Invention

The present invention relates to a dial plate structure and a watch.

2. Description of Related Art

Heretofore, there is known a structure disclosed in Japanese Unexamined Patent Application Publication No. 2009-281961 as a dial plate structure of an analog watch. Concretely, there is known a dial plate structure provided with an upper dial plate having a cutout portion at one part thereof, a sub needle rotatably arranged between the upper dial plate and a lower dial plate. The lower dial plate has a plurality of function display sections configured to be exposed through the cutout portion, and the sub needle indicates one of the plurality of function display sections.

In the above analog watch disclosed in JP-A-2009-281961, a user can look and see currently selected function by way of a function indicator provided at a tip of the sub needle and indicating one of the plurality of function display sections. However, the function indicator is relatively small to see, thus it is not easy for a user to quickly find a position of the function indicator or the function display section indicated by the function indicator, and thereby there is a possibility that the user falsely recognize the currently selected function.

SUMMARY OF THE INVENTION

The present invention is made, in view of the above mentioned problems, to provide a dial structure and a watch in which the function display section indicated by the function indicator is easy to look and see and can prevent false recognition of the function display section.

In order to solve at least one of the above-mentioned problems, according to a first aspect of the present invention, there is provided a dial plate structure, comprising: a first dial plate having a first opening or a first cutout portion at a predetermined portion thereof; a second dial plate arranged under the first dial plate and having a plurality of function display portions that are exposed through the first opening or the first cutout portion; and a rotary indicator arranged between the first and second dial plates, having a function indicator to selectively indicate one of the plurality of function display portions by rotating over the second dial plate, and partially exposed through the first opening or the first cutout portion; wherein the rotary indicator has a plurality of index markers respectively corresponding to the plurality of function display portions on the surface thereof, and wherein the first dial plate has a second opening or a second cutout portion at a position different from the first opening or the first cutout portion, the second opening or the second cutout portion being configured to expose one of the index markers when the function indicator indicates one of the function display portions, the one of the index markers corresponding to the indicated function display portion.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

Hereinafter, an embodiment of a watch according to the present invention is described with reference to the accompanying drawings.

Figure 1:
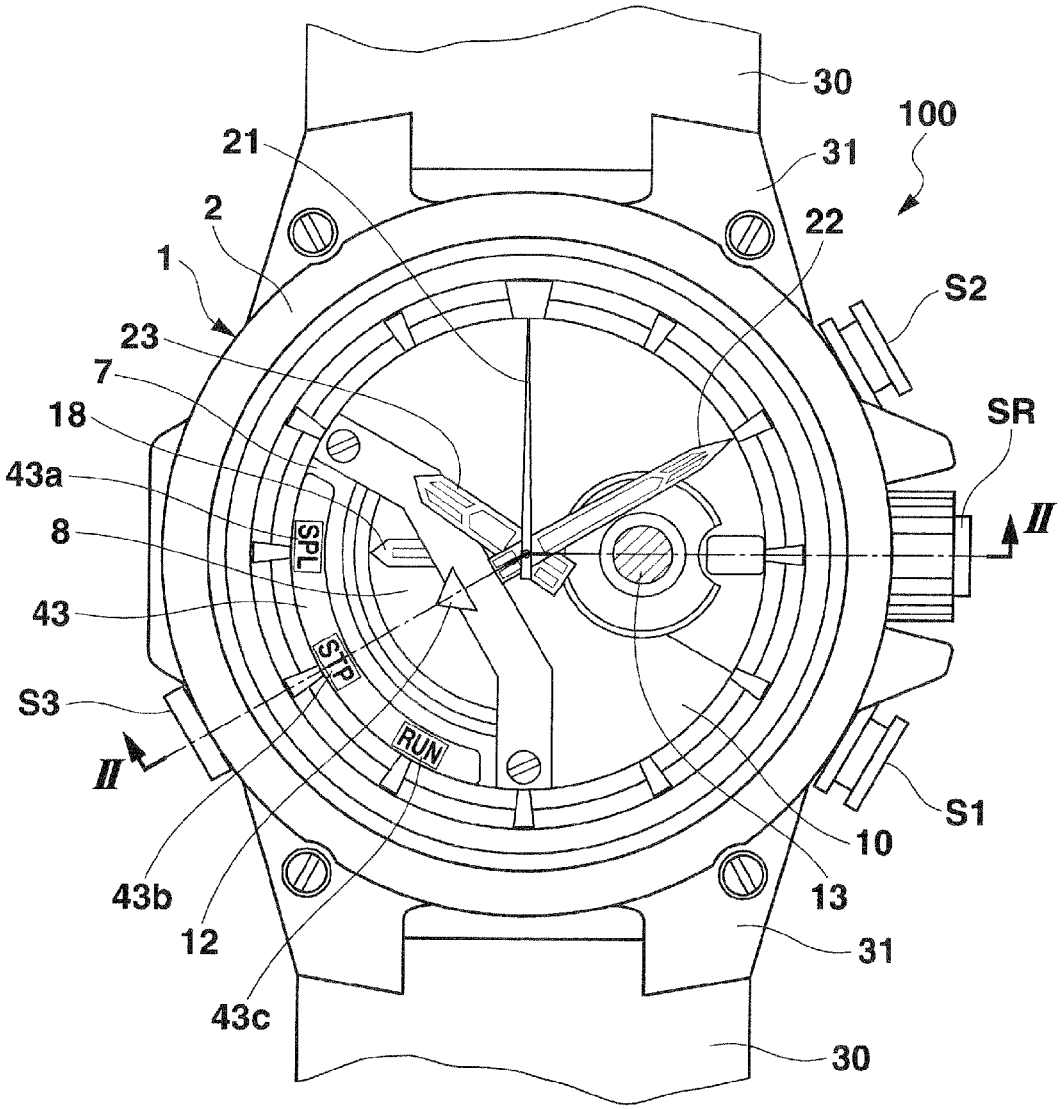
FIG. 1 is a plan view showing an analog watch according to an embodiment of the present invention.
Figure 2:
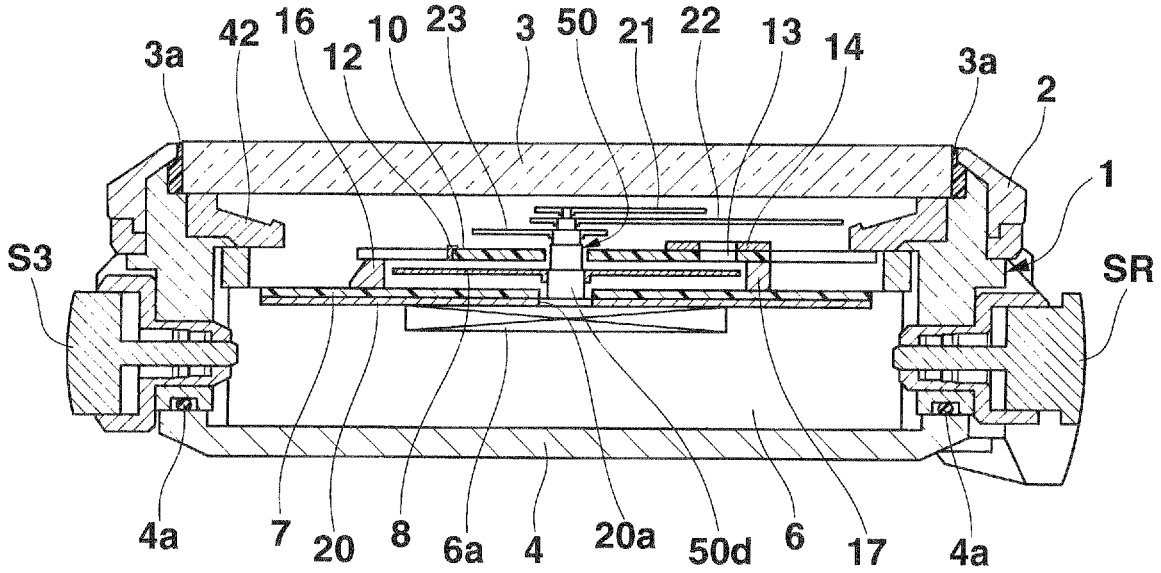
FIG. 2 is a sectional view showing the analog watch taken along the line II-II of FIG. 1.

A watch 100 according to the embodiment is an analog watch having, as shown in FIGS. 1 and 2, a watchcase 1 that constitutes a main body of the watch 100.

A bezel 2 is attached to an upper portion of an outer periphery of the watchcase 1. A watch glass 3 is attached to an upper periphery of an upper end opening of the watchcase 1 through a gasket 3*a*. A bottom cover 4 is attached to the bottom of the watchcase 1 through a water-resistant ring 4*a*. A stem SR and a plurality of push-button switches S1, S2, S3 and the like are provided at a periphery of the watchcase 1.

The watchcase 1 further includes two fittings 31, 31 for connecting wristbands 30, 30 in directions of twelve o'clock and six o'clock, respectively.

Figure 3:
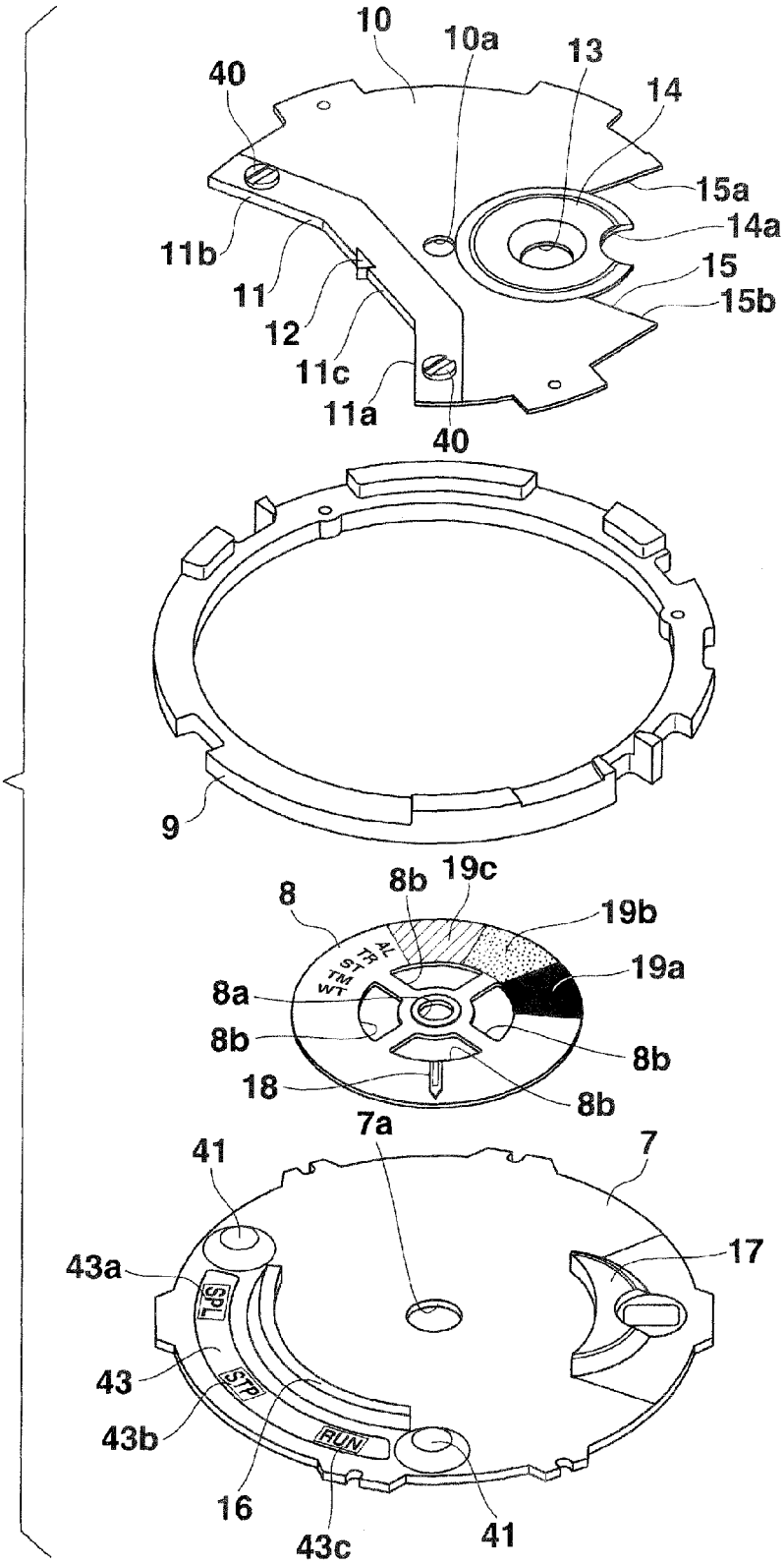
FIG. 3 is an exploded perspective view showing an upper dial plate, a lower dial cover, a discoid rotary indicator and a lower dial plate of the analog watch according to an embodiment of the present invention.

Further, at an inside of the watchcase 1, there are provided a housing 6 provided with a watch movement 6*a*, a lower dial plate 7 shown in FIG. 3, a discoid rotary indicator 8, a lower dial cover 9 and an upper dial plate 10.

Figure 4:
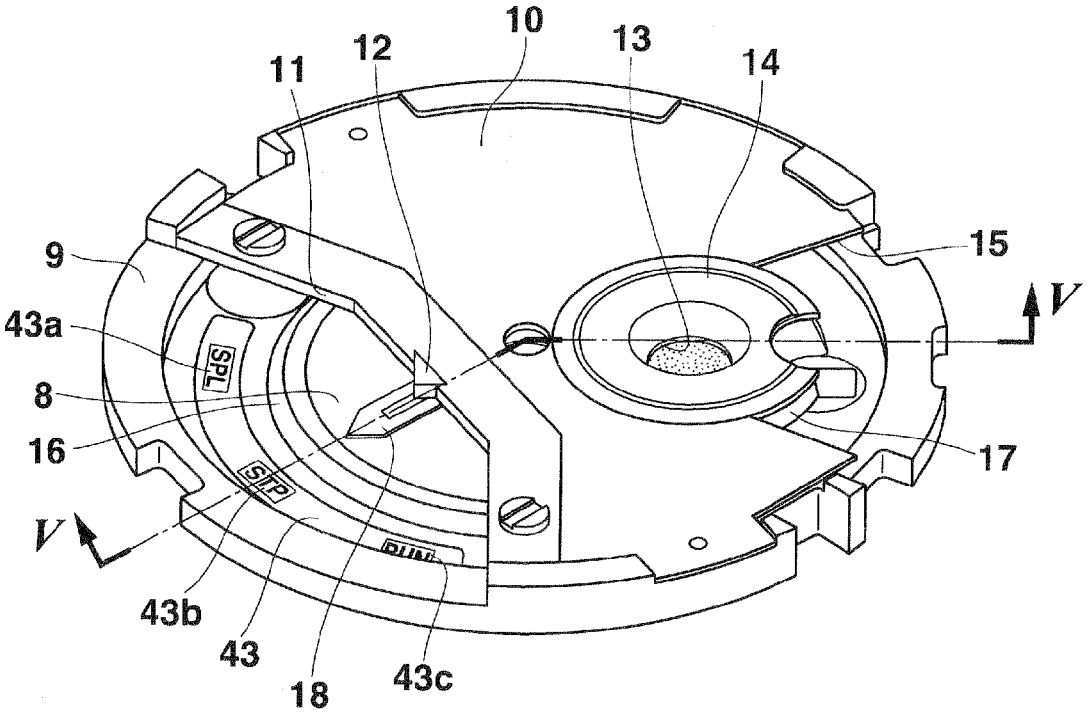
FIG. 4 is a sectional view showing a state in which the parts of FIG. 3 are assembled.
Figure 5:
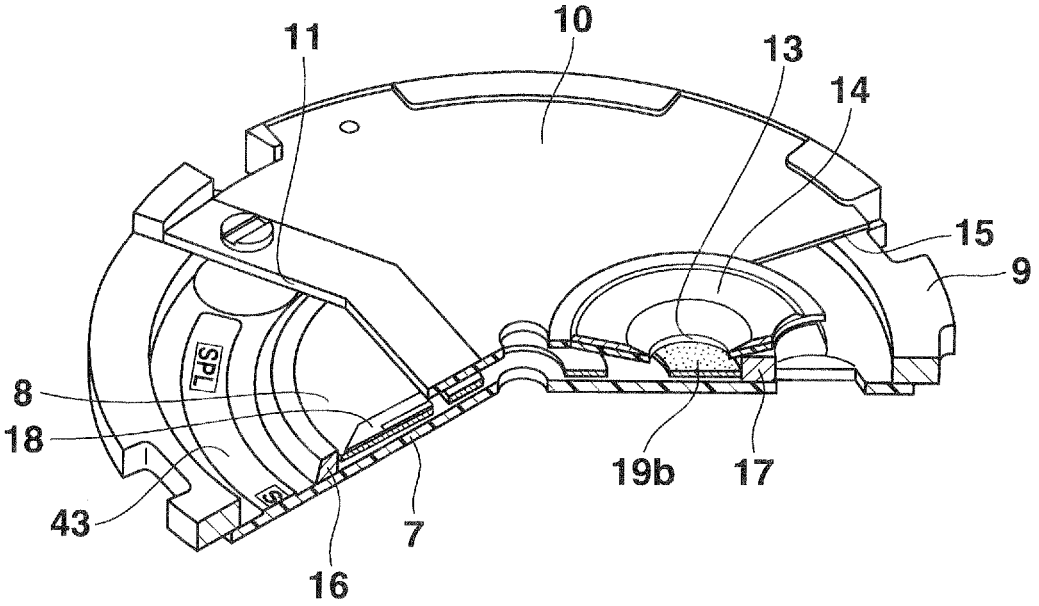
FIG. 5 is a perspective cross-sectional view showing an assembly taken along the line V-V of FIG. 4.

Here, the upper dial plate 10 will be explained. The upper dial plate 10 is composed of a transparent or translucent synthetic resin, such as a polycarbonate (PC) or an acrylic (e.g. PMMA). As shown in FIGS. 3 to 5, the upper dial plate 10 has a hole 10*a* through which a shaft is to be inserted. Moreover, the upper dial plate 10 has a cutout portion 11 (first cutout portion) formed in the range from around six o'clock to around ten o'clock of the watch 100.

The cutout portion 11 is formed to be compartmentalized to include a side 11*a* formed in a direction from six o'clock to a center of the upper dial plate 10, a side 11*b* formed in a direction from ten o'clock to the center of the upper dial plate 10, and a side 11*c* formed to be parallel with a diametrical direction between the sides 11*a* and 11*b*.

Moreover, a function indicator (information display section) 12 formed as a triangle-shaped projection is formed at a midportion of the side 11*c* to protrude toward the cutout portion 11.

Moreover, the upper dial plate 10 has a circular window 13 or an aperture at a midportion between the center of the upper dial plate 10 and an hour character representing three o'clock. A periphery of the window 13 constitutes an annular frame 14 raised from the surface of the upper dial plate 10. The frame 14 is formed of a metal such as, for example, a copper alloy such as a brass (Bs), aluminum (Al), and the like.

Moreover, the upper dial plate 10 has a cutout portion 15 (second cutout portion) formed in a range from around two o'clock to around four o'clock of the watch 100. The cutout portion 15 is formed to be compartmentalized to include a side 15*a* formed in a direction from around two o'clock to the center of the upper dial plate 10, a side 15*b* formed in a direction from around four o'clock to the center of the upper dial plate 10, and an outer edge of the frame 14 extending between the sides 15*a* and 15*b*.

Incidentally, the frame 14 has a cutout portion 14*a* formed to be concave toward three o'clock direction of the watch. An upper dial cover 42 is provided over the upper dial plate 10. The upper dial cover 42 has hour characters and world time display section (not shown) for displaying cities in the world, around the hour characters.

Next, the lower dial cover 9 will be described.

The lower dial cover 9 is annularly-shaped and is formed of a metal such as, for example, a copper alloy such as a brass (Bs), aluminum (Al), and the like. The upper dial plate 10 is mounted on the lower dial cover 9, and the lower dial plate 7 is arranged under the lower dial cover 9. The lower dial cover 9 is sandwiched between the upper dial plate 10 and the lower dial plate 7, and the plates 10 and 7 are fixed to the lower dial cover 9 with screws 40 on the upper dial plate inserted into female screw portions 41 on the lower dial plate 7. As a result, the lower dial cover 9 functions as a spacer that forms a predetermined gap between the upper dial plate 10 and the lower dial plate 7.

The discoid rotary indicator 8 is arranged between the upper and lower dial plates 10, 7 that are attached to the lower dial cover 9.

Next, the lower dial plate 7 will be explained.

The lower dial plate 7 is formed almost in a circular form and is composed of a transparent or translucent synthetic resin, such as a polycarbonate (PC) or an acrylic (e.g. PMMA). The lower dial plate 7 has a hole 7*a* through which the shaft is to be inserted.

The lower dial plate 7 has cover members 16 and 17 that are formed of a metal such as, for example, a copper alloy such as a brass (Bs), aluminum (Al), and the like.

Figure 6:
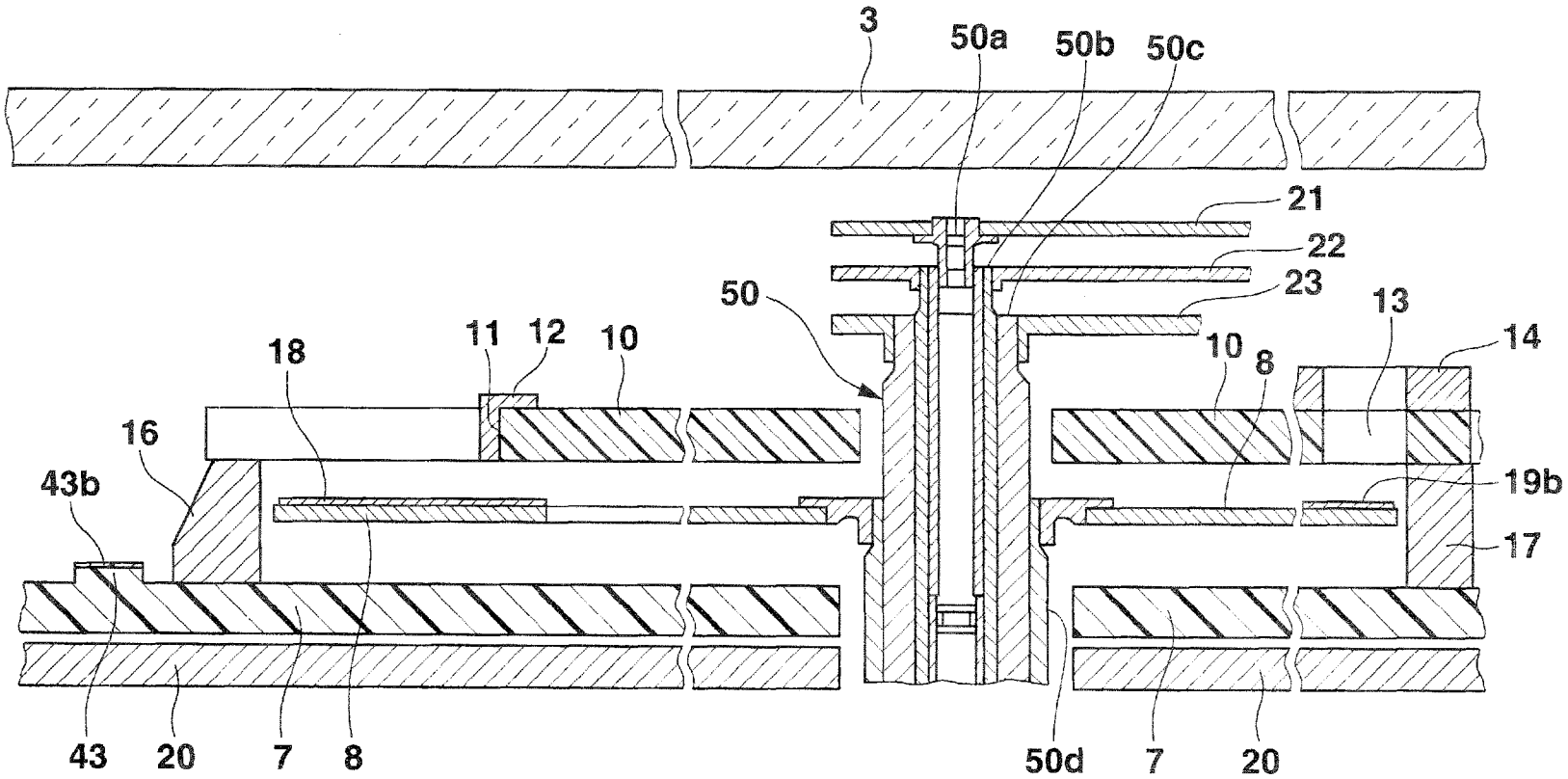
FIG. 6 is an enlarged sectional view showing main sections of the assembly of FIG. 4.

The cover member 16 is formed in the shape of an arc that is concave toward the center of the lower dial plate 7. The cover member 16 is formed in an area corresponding to the cutout portion 11 of the upper dial plate 10, i.e., from the side 11*a* to the side 11*b*. The curvature radius of an inner periphery of the cover member 16 is barely larger than a curvature radius of the discoid rotary indicator 8. As shown in FIG. 6, the cover member 16 is arranged at such position that the inner periphery thereof faces the outer periphery of the discoid rotary indicator 8. The cover member 16 functions to prevent the outer periphery of the discoid rotary indicator 8 or the gap between the dial plates 7 and 10 from visually contacted from a direction of the watch glass 3.

On the other hand, the cover member 17 is formed in the shape of a crescent moon that is concave toward the center of the lower dial plate 7. The cover member 17 is formed in an area under the frame 14. The curvature radius of an inner periphery of the cover member 17 is barely larger than a curvature radius of the discoid rotary indicator 8. The cover member 17 is formed at such position that the inner periphery thereof faces the outer periphery of the discoid rotary indicator 8 and that a part of the frame 14 is seated thereon. The cover member 17 has a cutout portion for exposing a day display window in a three o'clock direction. The cover member 17 functions to prevent the outer periphery of the discoid rotary indicator 8 or the gap between the dial plates 7 and 10 from visually contacted from a direction of the watch glass 3.

Moreover, on the surface of the lower dial plate 7, there provided a plurality of function display sections (information display sections) "SPL" 43*a*, "STP" 43*b* and "RUN" 43*c* for displaying detailed functions of a stopwatch function, on a position radially outward than the cover member 16. The plurality of function display sections are arranged at a predetermined space in a circumferential direction of the lower dial plate 7. Here, the indication "SPL" indicates a split display function, the indication "STP" indicates a stop function, and the indication "RUN" indicates an integrated timer function.

Incidentally, in FIGS. 1 and 3, a reference numeral 43 indicates a function display area (information display area) in which the plurality of function display sections SPL 43*a*, STP 43*b* and a RUN 43*c* are formed.

Next, the discoid rotary indicator 8 will be explained.

The discoid rotary indicator 8 is formed of aluminum (Al), for example. The discoid rotary indicator 8 has a hole 8*a* through which the shaft is to be inserted. The discoid rotary indicator 8 has four fan-shaped apertures 8*b*, which are arranged centering on the center of the discoid rotary indicator 8, on immediately outside the hole 8*a*. These fan-shaped apertures 8*b* are formed in order to increase the light quantity that reaches to a solar panel 20. Moreover, on an outer periphery of an upper surface of the discoid rotary indicator 8, there provided a plurality of function display sections (information display sections) "TM", "ST", "TR", "AL" and "WT", an arrow-shaped function indicator (information indicator) 18 and a plurality of fun-shaped indicators (information sections) 19*a*, 19*b* and 19*c*.

Here, the indication "TM" indicates a basic watch function, "ST" indicates the stopwatch function, "TR" indicates a timer function, "AL" indicates an alarm function, and "WT" indicates a world time function.

The indicator 19*a* is black and is formed at such position as to be exposed through the window 13 of the upper dial plate 10 when the arrow-shaped function indicator 18 provided on the discoid rotary indicator 8 indicates the character "RUN" of the lower dial plate 7.

Moreover, the indicator 19*b* is red and is formed at such position as to be exposed through the window 13 of the upper dial plate 10 when the arrow-shaped function indicator 18 provided on the discoid rotary indicator 8 indicates the character "STP" of the lower dial plate 7.

Further, the indicator 19*c* is blue and is formed at such position as to be exposed through the window 13 of the upper dial plate 10 when the arrow-shaped function indicator 18 provided on the discoid rotary indicator 8 indicates the character "SPL" of the lower dial plate 7.

Figure 8:
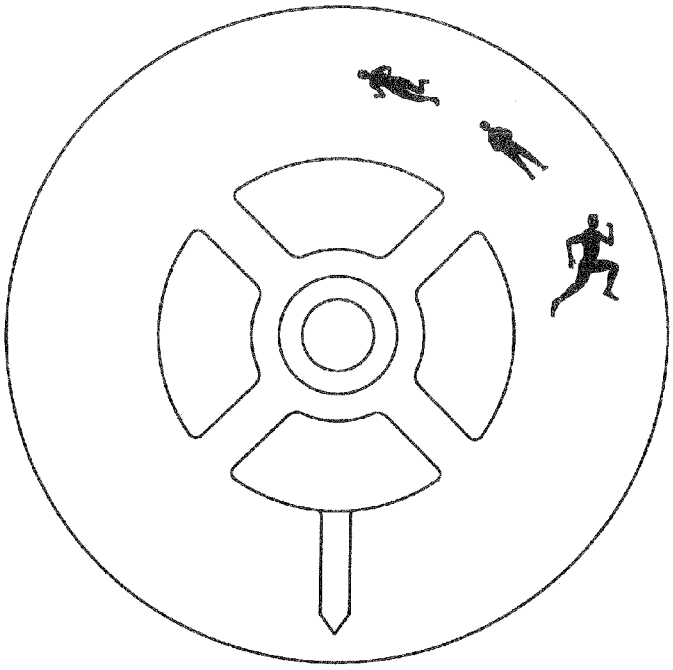
FIG. 8 is a plan view showing a first modification of the discoid rotary indicator.
Figure 9:
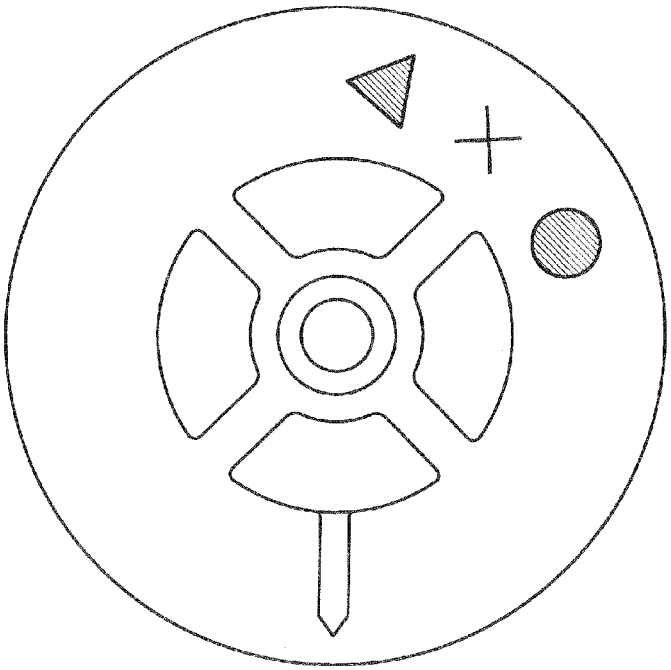
FIG. 9 is a plan view showing a second modification of the discoid rotary indicator.

Incidentally, the indicators 19*a*, 19*b* and 19*c* are not necessarily configured to have different colors with each other, but may be formed to have different pictures as shown in FIG. 8, or different marks as shown in FIG. 9, for example.

As shown in FIG. 2, the solar panel 20 is arranged under the lower dial plate 7 at the inside of the watchcase 1. The solar panel 20 is to generate electromotive force in response to reception of an outside light from the watch glass 3, and the generated electromotive force is used, for example, to charge a secondary battery.

The solar panel 20 has a hole 20*a* through which the shaft is to be inserted.

A drive shaft 50 that is used for the indicator and is connected to the watch movement 6*a* is being inserted through the hole 20*a* of the solar panel 20, the hole 7*a* of the lower dial plate 7, the hole 8*a* of the discoid rotary indicator 8, and the hole 10*a* of the upper dial plate 10, from below. A second hand 21, a minute hand 22 and an hour hand 23 are attached to the drive shaft 50 at an upper portion upwardly protruding from the upper dial plate 10. A drive shaft 50*d*, including the drive shaft 50, connected to the watch movement 6*a*, and used for the indicator, is being inserted through the hole 20*a* of the solar panel 20 and the hole 7*a* of the lower dial plate 7, from below. The discoid rotary indicator 8 is attached to the shaft 50*d*.

The drive shaft 50 is, as shown in FIG. 6, composed of a second hand shaft 50*a*, a minute hand shaft 50*b*, an hour hand shaft 50*c* and the shaft 50*d* for the function indicator. These shafts 50*a*, 50*b*, 50*c* and 50*d* are arranged to form a nested structure. The second hand 21, the minute hand 22, the hour hand 23 and the discoid rotary indicator 8 are attached to the upper end portion of the second hand shaft 50*a*, the upper end portion of the minute hand shaft 50*b*, the upper end portion of the hour hand shaft 50*c* and the upper end portion of the shaft 50*d* for the function indicator, respectively.

As a result, the second hand 21, the minute hand 22, the hour hand 23 and the discoid rotary indicator 8 rotate centering on the drive shaft 50 which is concentric therewith.

Figure 7:
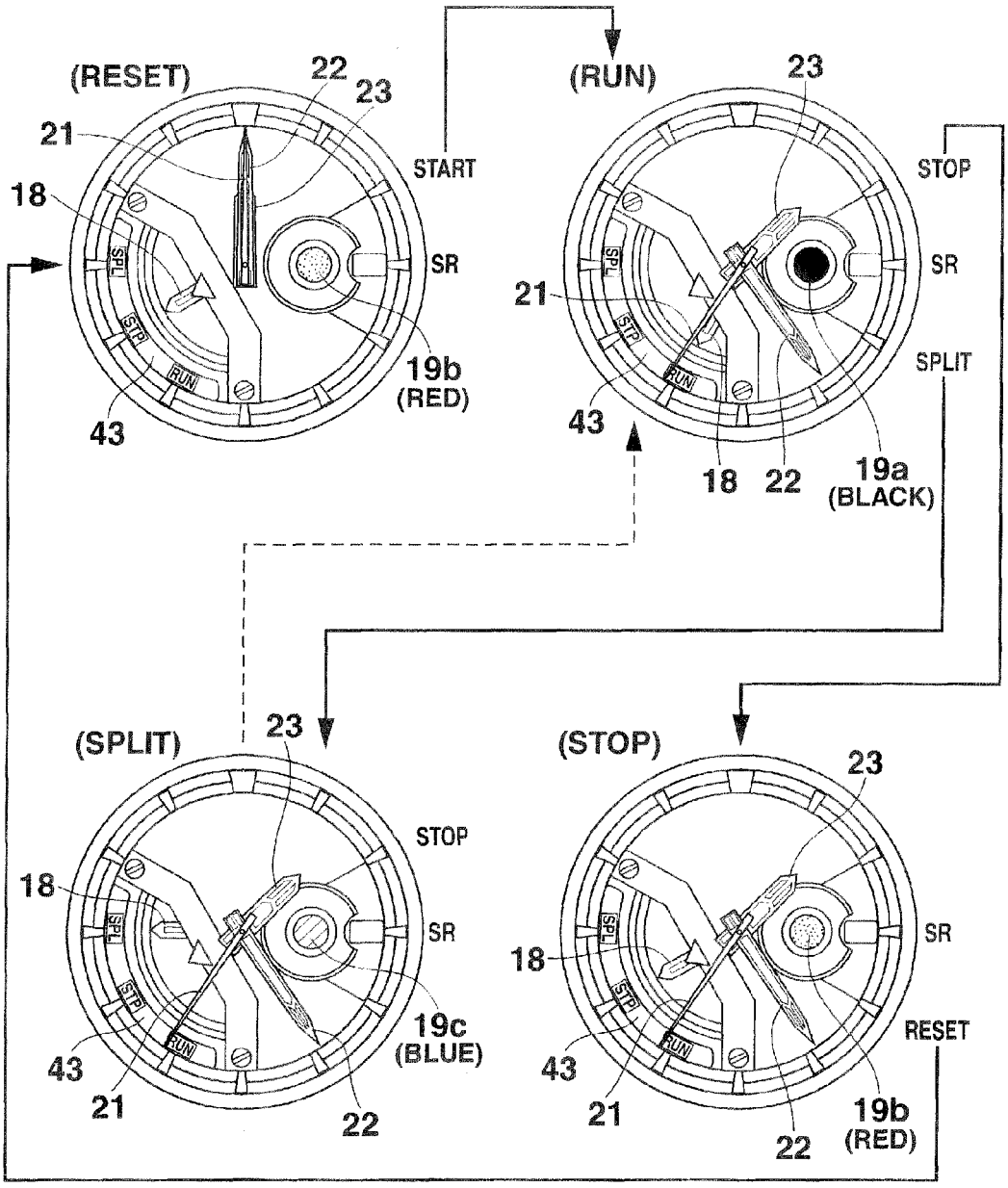
FIG. 7 is a plan view showing a plurality of states of a dial structure operated as a stopwatch.

Next, an operation at the time of switching the function modes in the watch 100 will be explained with reference to FIG. 7.

Prior to switching the function modes, when the stem SR shown in FIG. 1 is pushed in a condition where the watch is in the basic watch function mode for displaying the time, the discoid rotary indicator 8 shown in FIG. 3 rotates by a predetermined angle every time the user pushes the stem SR, and the function indicator 12 of the upper dial plate 10 indicates the plurality of function display sections ST, TR, AL, WT or TM, one by one. Accordingly, the function mode is switched to the mode represented by any one of the plurality of (for example, five in this embodiment) function display sections ST, TR, AL, WT and TM, and thereby one of the function modes which the user is going to use is set.

Next, referring to a stopwatch function mode as an example among thus set function modes, a detailed function mode of the stopwatch function mode will be explained according to FIG. 7.

When the stopwatch function mode is set, the discoid rotary indicator 8 automatically rotates in response to the setting, the function indicator 18 provided on the rotary indicator 8 points out STP of the lower dial plate 7, and then the red function display section 19*b* is exposed through the window 13 of the upper dial plate 10. Further, the hour hand 23, the minute hand 22 and the second hand 21 point to exactly twelve o'clock (0 h 0 m 0 s). This condition indicates "INITIAL (RESET)" state of the stopwatch function mode.

When the push-button switch S2 shown in FIG. 1 is pushed under this condition, the push-button switch S2 functions as a START switch, the discoid rotary indicator 8 rotates, the function indicator 18 points out "RUN" 43*c* on the lower dial plate 7, and the black function display section 19*a* is exposed through the window 13. Moreover, at the same time, the hour hand 23, the minute hand 22 and the second hand 21 start handling of needles.

When the push-button switch S2 shown in FIG. 1 is pushed again from this "RUN (START)" condition, the push-button switch S2 functions as a STOP switch, the discoid rotary indicator 8 rotates, the function indicator 18 points out "STP" 43*b* on the lower dial plate 7, and the red function display section 19*b* is exposed through the window 13 of the upper dial plate 10. Moreover, at the same time, the hour hand 23, the minute hand 22 and the second hand 21 that are in the handling of needle condition stop the handling of needle. The hour hand 23, the minute hand 22 and the second hand 21 correspond to a minute hand, a second hand, and a needle to indicate one-twentieth second, respectively, in the stopwatch function mode. Therefore, an elapsed time (accumulated period) since the push-button switch S2 is firstly pushed is indicated by the handling of needles of the hour hand 23, the minute hand 22 and the secondhand 21, over time. This condition indicates "STOP" state in the stopwatch function mode.

Next, when the push-button switch S1 is pushed in the STP condition, the push-button switch S1 functions as a RESET switch, thereby the function indicator 18 of the discoid rotary indicator 8 maintain pointing the "STP" 43*b*, and the hour hand 23, the minute hand 22 and the second hand 21 moves to point twelve o'clock (0 h 0 m 0 s) with the red function display section 19*b* being exposed through the window 13 of the upper dial plate 10. The watch 100 thus becomes the RESET state.

On the other hand, when the push-button switch S1 shown in FIG. 1 is pushed under the "RUN (START)" state after firstly having pushed the push-button switch S2 shown in FIG. 1, the push-button switch S1 functions as a SPLIT switch, thereby the function indicator 18 of the discoid rotary indicator 8 points out the "SPL" 43*a* of the lower dial plate 7 and the blue function display section 19*c* is exposed through the window 13 of the upper dial plate 10. Moreover, at the same time, because the hour hand 23, the minute hand 22 and the second hand 21 constitutes needles respectively corresponding to the minute hand, the second hand and the needle to indicate one-twentieth second in the stopwatch function mode, a split time (elapsed time from the start to an any time) is indicated by the handling of needles of the hour hand 23, the minute hand 22 and the second hand 21. This condition indicates "SPLIT" state in the stopwatch function mode.

Thereafter, if the watch 100 has been left five or more seconds under the condition, the SPL function is automatically canceled and the watch 100 returns back to the RUN function (START function). Then, the function indicator 18 of the discoid rotary indicator 8 points out RUN 43*c* in the lower dial plate 7 and the black function display section 19*a* is exposed through the window 13 of the upper dial plate 10. Moreover, at the same time, the hour hand 23, the minute hand 22 and the second hand 21 correspond to a minute hand, a second hand, and a needle to indicate one-twentieth second, respectively, in the stopwatch function mode. Therefore, the total elapsed time (accumulated period) since the push-button switch S2 is firstly pushed is indicated by the handling of needles of the hour hand 23, the minute hand 22 and the second hand 21, over time.

According to the analog watch 100 of this embodiment, the following advantageous effect can be obtained.

That is, when the function indicator 18 of the discoid rotary indicator 8 points out one of the plurality of function display sections 43*a*, 43*b* and 43*c* (SPL, STP and RUN), one of the indicator 19*a*, 19*b* and 19*c* that corresponds to the pointed one function display section 43*a*, 43*b* or 43*c* (SPL, STP or RUN) is exposed through the window 13. Thereby, the user can easily look and see one of the function display sections 43*a*, 43*b* or 43*c* (SPL, STP or RUN) pointed out by the function indicator 18 by visually contacting the indicator 19*a*, 19*b* or 19*c* exposed through the window 13. Moreover, at the same time, it is possible to prevent the user from falsely recognizing the currently selected function when reading the function.

Further, because the indicators 19*a*, 19*b* and 19*c* are formed in such styles (colors) different from those of the function display sections, it is easy to confirm the set function and is possible to prevent the false recognition, to the utmost extent.

The entire disclosure of Japanese Patent Application No. 2011-187266 filed on Aug. 30, 2011 including description, claims, drawings, and abstract are incorporated herein by reference in its entirety.

Although various exemplary embodiments have been shown and described, the invention is not limited to the embodiments shown. Therefore, the scope of the invention is intended to be limited solely by the scope of the claims that follow.

What is claimed is:

1. A dial plate structure, comprising:

a first dial plate having a first opening or a first cutout portion at a predetermined portion thereof;

a second dial plate arranged under the first dial plate and having a plurality of function display portions that are exposed through the first opening or the first cutout portion; and a rotary indicator arranged between the first and second dial plates, having a function indicator to selectively indicate one of the plurality of function display portions by rotating over the second dial plate, and partially exposed through the first opening or the first cutout portion;

wherein the rotary indicator has a plurality of index markers respectively corresponding to the plurality of function display portions on the surface thereof, and wherein the first dial plate has a second opening or a second cutout portion at a position different from the first opening or the first cutout portion, the second opening or the second cutout portion being configured to expose one of the index markers when the function indicator indicates one of the function display portions, the one of the index markers corresponding to the indicated function display portion.

2. The dial plate structure according to claim 1, wherein the rotary indicator is configured to be a discoid.

3. The dial plate structure according to claim 1, wherein the plurality of index markers have different colors with each other.

4. The dial plate structure according to claim 1, wherein the plurality of index markers have different pictures with each other.

5. The dial plate structure according to claim 1, wherein the plurality of index markers have different marks with each other.

6. The dial plate structure according to claim 1, further comprising:

a drive shaft that penetrates the first and second dial plates to protrude upwardly from the first dial plate; and an indicator attached to an upper portion of the drive shaft protruding from the first dial plate.

7. The dial plate structure according to claim 6, wherein the rotary indicator is rotatable around the drive shaft.

8. A watch, comprising:

a watchcase having a watch glass at an upper surface thereof;

a first dial plate arranged inside the watchcase to be opposed to the watch glass, and having a first opening or a first cutout portion at a predetermined portion thereof;

a second dial plate arranged under the first dial plate and having a plurality of function display portions that are exposed through the first opening or the first cutout portion; and a rotary indicator arranged between the first and second dial plates, having a function indicator to selectively indicate one of the plurality of function display portions by rotating over the second dial plate, and partially exposed through the first opening or the first cutout portion;

wherein the rotary indicator has a plurality of index markers respectively corresponding to the plurality of function display portions on the surface thereof, and wherein the first dial plate has a second opening or a second cutout portion at a position different from the first opening or the first cutout portion, the second opening or the second cutout portion being configured to expose one of the index markers when the function indicator indicates one of the function display portions, the one of the index markers corresponding to the indicated function display portion.

9. The watch according to claim 8, wherein the rotary indicator is configured to be a discoid.

10. The watch according to claim 8, wherein the plurality of index markers have different colors with each other.

11. The watch according to claim 8, wherein the plurality of index markers have different pictures with each other.

12. The watch according to claim 8, wherein the plurality of index markers have different marks with each other.

13. The watch according to claim 8, further comprising an indicator arranged between the watch glass and the first dial plate, to indicate the time, wherein the rotary indicator is rotatable around a drive shaft of the indicator.

14. The watch according to claim 8, further comprising a movement arranged inside the watchcase and having a drive shaft that penetrates the first and second dial plates to protrude upwardly from the first dial plate; and an indicator attached to an upper portion of the drive shaft protruding from the first dial plate.

15. The watch according to claim 14, wherein the rotary indicator is rotatable around the drive shaft.

* * * * *